US009879643B2

(12) United States Patent
Shimogawa et al.

(10) Patent No.: US 9,879,643 B2
(45) Date of Patent: Jan. 30, 2018

(54) FUEL PUMP MOUNTING STRUCTURE FOR ENGINE

(71) Applicant: MAZDA MOTOR CORPORATION, Hiroshima (JP)

(72) Inventors: Yuki Shimogawa, Hiroshima (JP); Toru Miyamae, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 15/238,017

(22) Filed: Aug. 16, 2016

(65) Prior Publication Data

US 2017/0074221 A1 Mar. 16, 2017

(30) Foreign Application Priority Data

Sep. 11, 2015 (JP) ..... 2015-179759

(51) Int. Cl.
*F02M 39/02* (2006.01)
*F02M 59/10* (2006.01)
(Continued)

(52) U.S. Cl.
CPC ..... *F02M 39/02* (2013.01); *F02M 59/102* (2013.01); *F02M 63/0001* (2013.01);
(Continued)

(58) Field of Classification Search
CPC .. F02M 39/02; F02M 63/0001; F02M 59/102; F04B 53/18; F04B 53/16; F04B 17/05; F04B 9/042
See application file for complete search history.

(56) References Cited

U.S. PATENT DOCUMENTS 2,478,528 A * 8/1949 Edwards ..... F02M 41/12 417/265
6,210,129 B1 4/2001 Stiefel
(Continued)

FOREIGN PATENT DOCUMENTS

DE 197 12 872 A1 10/1998
GB 2519464 A 4/2015
(Continued)

OTHER PUBLICATIONS

An Office Action issued by the German Patent Office dated May 3, 2017, which corresponds to German Patent pplication No. 10 2016 010 746.4 and is related to U.S. Appl. No. 15/238,017; with English language translation.
An Office Action; "Notice of Reasons for Rejection" issued by the Japanese Patent Office dated Nov. 21, 2017, which corresponds to Japanese Patent Application No. 2015-179759 and is related to U.S. Appl. No. 15/238,017; with English language Concise Explanation.

*Primary Examiner* — Joseph Dallo
(74) *Attorney, Agent, or Firm* — Studebaker & Brackett PC

(57) ABSTRACT

In a structure for mounting, on a cylinder block, a fuel pump including a fuel pump drive shaft which is rotated by receiving a driving force of a crankshaft, and a fuel pump body which is operated as the fuel pump drive shaft is rotated for pumping fuel, the cylinder block includes a flange portion, on an end portion of the cylinder block in the crankshaft direction, projecting from a surface of the end portion along the crankshaft direction in a direction orthogonal to the crankshaft direction. The flange portion includes a bearing portion which rotatably supports the fuel pump drive shaft, and a pump accommodating hole portion which accommodates the fuel pump body. The fuel pump drive shaft is rotatably supported on the bearing portion, and the fuel pump body is accommodated in the pump accommodating hole portion.

8 Claims, 15 Drawing Sheets

(51) Int. Cl.

| | |
|---|---|
| ***F02M 63/00*** | (2006.01) |
| ***F04B 9/04*** | (2006.01) |
| ***F04B 17/05*** | (2006.01) |
| ***F04B 53/16*** | (2006.01) |
| ***F04B 53/18*** | (2006.01) |

(52) U.S. Cl.
CPC ..... *F04B 9/042* (2013.01); *F04B 17/05* (2013.01); *F04B 53/16* (2013.01); *F04B 53/18* (2013.01)

(56) References Cited

U.S. PATENT DOCUMENTS

| | | | | |
|---|---|---|---|---|
| 7,743,749 | B1 * | 6/2010 | Suchecki ..... | F01L 1/022 123/495 |
| 2007/0227509 | A1 * | 10/2007 | Ueda ..... | F01L 1/022 123/509 |
| 2015/0211455 | A1 | 7/2015 | Hasegawa et al. | |

FOREIGN PATENT DOCUMENTS

| | | | |
|---|---|---|---|
| JP | S58-008747 | U | 1/1983 |
| JP | S58-062111 | U | 4/1983 |
| JP | H05-077515 | U | 10/1993 |
| JP | H09-296765 | A | 11/1997 |
| JP | 2003-148273 | A | 5/2003 |
| JP | 2007-016716 | A | 1/2007 |

* cited by examiner

FUEL PUMP MOUNTING STRUCTURE FOR ENGINE

FIELD OF THE INVENTION

The present invention relates to a fuel pump mounting structure for an engine.

BACKGROUND ART

Conventionally, a fuel pump for supplying fuel to an engine body is directly connected to a valve system camshaft in the engine body, and driven.

However, when a high-pressure fuel pump is necessary, a driving force of a valve system camshaft may be deprived of by a fuel pump because the driving load of the fuel pump is large. In view of the above, in order to avoid lowering of a driving force of a valve system camshaft, there is proposed an idea, in which a drive shaft independent of the valve system camshaft and dedicatedly used for a high-pressure fuel pump is provided, a fuel pump is connected to the drive shaft, and the fuel pump is driven via the drive shaft for isolating the fuel pump from the valve system camshaft in terms of a structure.

Specifically, a flange portion is formed on an end portion of a cylinder block in the crankshaft direction to project from a surface of the end portion along the crankshaft direction in a direction orthogonal to the crankshaft direction. Further, a high-pressure fuel pump is mounted on one surface of the flange portion in a cantilever state. The high-pressure fuel pump includes a pump body, a pump housing surrounding the pump body, and a dedicated pump drive shaft which is rotatably supported on the pump housing. For instance, Japanese Unexamined Patent Publication No. 2007-16716 discloses, as a structure similar to the aforementioned structure, a configuration, in which a bulging portion is formed on a vehicle-front-side portion of a chain cover for covering a timing chain to bulge from the vehicle-front-side portion toward the vehicle front side, and a high-pressure fuel pump is fixed to one surface of the bulging portion in a cantilever state.

In the aforementioned structure, when a high-pressure fuel pump is disposed on the transmission side of a cylinder block, the offset amount of the high-pressure fuel pump from a crankshaft further increases in order to avoid interference between the high-pressure fuel pump and a transmission.

In the conventional mounting structure as described above, the following drawback may occur. Specifically, a high-pressure fuel pump, which is a heavy object, is mounted on a surface of a flange portion projecting from a surface of an engine in a cantilever state. This makes it difficult to sufficiently secure support rigidity of the fuel pump.

Further, positional precision of a pump drive shaft with respect to a cylinder block may not be sufficiently obtained due to a mounting error of a fuel pump with respect to a flange portion. As a result, tension of a timing chain may not be kept in an appropriate state, and a driving resistance of an engine may increase. This may deteriorate fuel efficiency.

There is an idea that the thickness of a flange portion is increased in the crankshaft direction in order to increase the rigidity of the flange portion. However, if the thickness of a flange portion is increased, the length of an intake manifold in the crankshaft direction may be limited. Therefore, there is a limit in increasing the rigidity of a flange portion by increasing the thickness of the flange portion.

SUMMARY OF THE INVENTION

In view of the above, an object of the present invention is to provide, in a structure in which a fuel pump is offset with respect to a crankshaft in a direction orthogonal to the crankshaft direction, a fuel pump mounting structure for an engine, which enables to increase the support rigidity and positional precision of the fuel pump.

In order to solve the aforementioned drawback, an aspect of the present invention is directed to a fuel pump mounting structure for an engine. The fuel pump mounting structure for an engine is a structure for mounting, on a cylinder block, a fuel pump including a fuel pump drive shaft which is rotated by receiving a driving force of a crankshaft, and a fuel pump body which is operated as the fuel pump drive shaft is rotated for pumping fuel. The cylinder block includes a flange portion, on an end portion of the cylinder block in a crankshaft direction, projecting from a surface of the end portion along the crankshaft direction in a direction orthogonal to the crankshaft direction. The flange portion includes a bearing portion which rotatably supports the fuel pump drive shaft, and a pump accommodating hole portion which accommodates the fuel pump body. The fuel pump drive shaft is rotatably supported on the bearing portion. The fuel pump body is accommodated in the pump accommodating hole portion.

According to the present invention, in a structure in which a fuel pump is offset with respect to a crankshaft in a direction orthogonal to the crankshaft direction, it is possible to provide a fuel pump mounting structure for an engine, which enables to increase the support rigidity and positional precision of the fuel pump.

These and other objects, features and advantages of the present invention will become more apparent upon reading the following detailed description along with the accompanying drawings.

DETAILED DESCRIPTION OF THE PREFERRED EMBODIMENTS OF THE INVENTION

Figure 1:
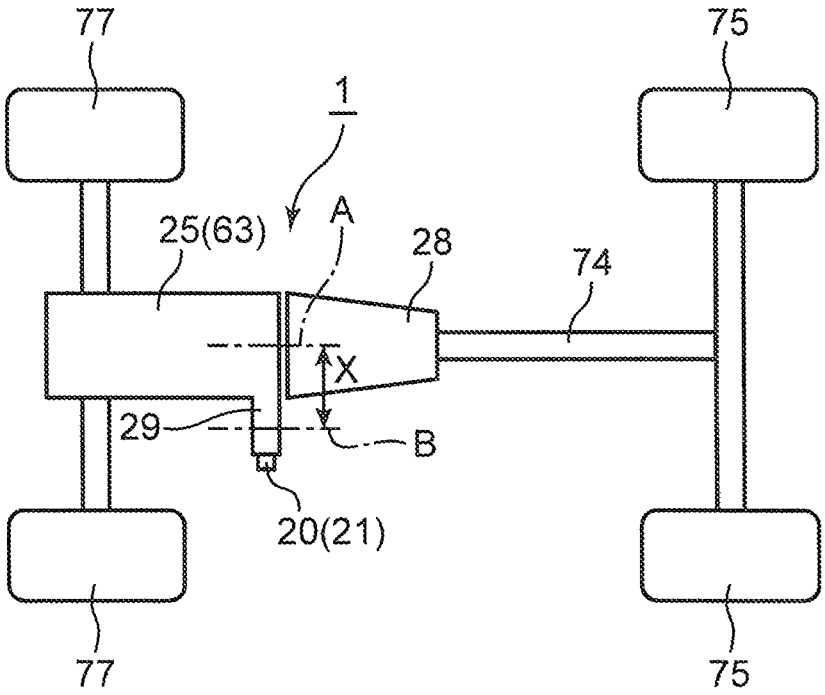
FIG. 1 is a plan view schematically illustrating a configuration of a vehicle in an embodiment of the present invention.

In the following, a preferred embodiment of the present invention is described referring to the drawings.

Figure 2:
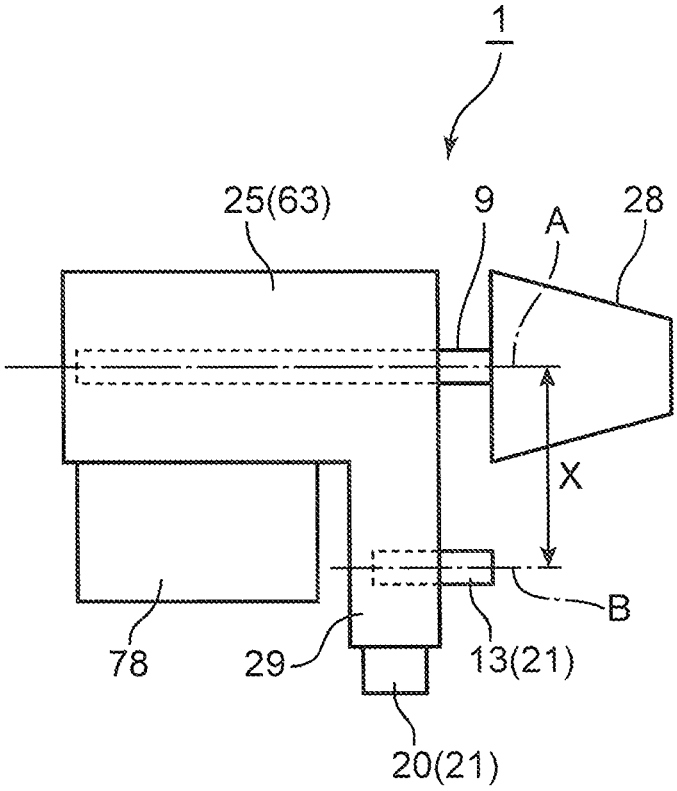
FIG. 2 is a plan view schematically illustrating a fuel pump mounting structure according to the embodiment of the present invention.
Figure 3:
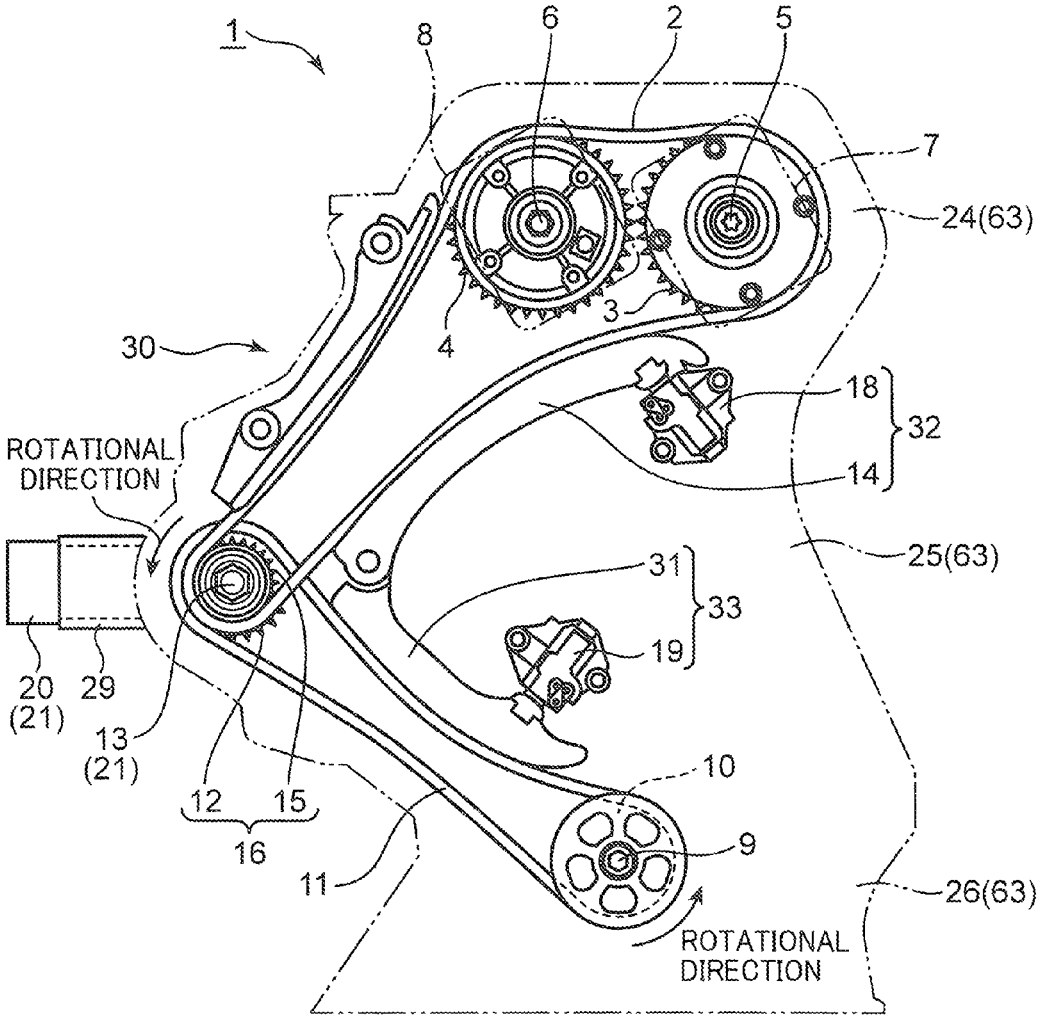
FIG. 3 is a schematic view of an engine in the embodiment of the present invention when viewed from the engine rear side (a side where a transmission is disposed)

As illustrated in FIG. 2 and FIG. 3, a fuel pump mounting structure for an engine according to an embodiment of the present invention is a structure for mounting, on a cylinder block 25, a fuel pump 21 provided with a fuel pump drive shaft 13 which is rotated by receiving a driving force of a crankshaft 9, and a fuel pump body 20 which is operated as the fuel pump drive shaft 13 is rotated for pumping fuel.

An engine 1 (see FIG. 1) to which the fuel pump mounting structure of the embodiment is applied is an engine for a vehicle such as an automobile. The engine 1 is an in-line 4-cylinder gasoline engine, which is placed in an engine room in a vehicle front portion in a vertical posture in such a manner that an intake port (not illustrated) is directed toward the vehicle left side, and an exhaust port (not illustrated) is directed toward the vehicle right side.

In other words, the engine 1 is disposed in a state that the cylinder array direction is aligned with the vehicle front-rear direction. The vehicle illustrated in FIG. 1 is an FR (front-engine rear-drive) car.

In the following description, a direction in which a crankshaft extends is referred to as a crankshaft direction. Further, the side where a transmission is disposed in the crankshaft direction is referred to as an engine rear side, and the side opposite to the engine rear side is referred to as an engine front side.

As illustrated in FIG. 1 to FIG. 3, the engine 1 is provided with an engine body 63 including the cylinder block 25 and a cylinder head 24 (see FIG. 3) disposed on the upper surface of the cylinder block 25 as main members, an intake manifold 78 (see FIG. 2) and an exhaust manifold (not illustrated) that are assembled to the engine body 63, a driving force transmission system (see FIG. 3), an auxiliary device such as the fuel pump 21, and a transmission 28 (transmission unit) (see FIG. 2 and FIG. 2) mounted to a surface of the cylinder block 25 of the engine body 63 on the engine rear side (namely, on a surface of the cylinder block 25 on the vehicle rear side in the example illustrated in FIG. 1).

A configuration of the driving force transmission system 30 is described. As illustrated in FIG. 3, the driving force transmission system 30 is a system for transmitting a driving force of the crankshaft 9 constituting the engine 1 to an exhaust camshaft 5 and to an intake camshaft 6 by timing chains 11 and 2.

The driving force transmission system 30 is provided with the crankshaft 9, a crank sprocket 10, the exhaust camshaft 5, an exhaust cam sprocket 3, the intake camshaft 6, an intake cam sprocket 4, the fuel pump drive shaft 13, a dual sprocket 16, the first timing chain 11, the second timing chain 2, an exhaust-side variable valve timing mechanism 7, an intake-side variable valve timing mechanism 8, and tensioner devices 32 and 33.

The tensioner device 33 includes a tension arm 31 which comes into contact with the first timing chain 11, and a tensioner body 19, which is an actuator for pressing the tension arm 31 against the first timing chain 11.

The tensioner device 32 includes a tension arm 14 which comes into contact with the second timing chain 2, and a tensioner body 18, which is an actuator for pressing the tension arm 14 against the second timing chain 2.

The exhaust-side variable valve timing mechanism 7 is an electrically operated variable valve timing mechanism disposed on the exhaust camshaft 5. The exhaust-side variable valve timing mechanism 7 changes the opening timing and the closing timing of exhaust valves by sequentially changing the rotational phase of the exhaust camshaft 5 with respect to the crankshaft 9 within a predetermined angle range. The exhaust camshaft 5 and the exhaust cam sprocket 3 are connected to each other via the exhaust-side variable valve timing mechanism 7.

The intake-side variable valve timing mechanism 8 is an electrically operated variable valve timing mechanism disposed on the intake camshaft 6. The intake-side variable valve timing mechanism 8 changes the opening timing and the closing timing of intake valves by sequentially changing the rotational phase of the intake camshaft 6 with respect to the crankshaft 9 within a predetermined angle range. The intake camshaft 6 and the intake cam sprocket 4 are connected to each other via the intake-side variable valve timing mechanism 8.

The crankshaft 9 is a rotational shaft configured to obtain a driving force by reciprocating motion of pistons (not illustrated) as a rotational force. The crank sprocket 10 is disposed on the crankshaft 9. In the example illustrated in FIG. 3, the crankshaft 9 is rotated in the counterclockwise direction.

As illustrated in FIG. 3, the fuel pump drive shaft 13 is a rotational shaft disposed between the crankshaft 9, and the exhaust camshaft 5 and the intake camshaft 6 in the height direction of the engine. A rotational force of the crankshaft 9 is transmitted to the fuel pump drive shaft 13 via the first timing chain 11. The fuel pump drive shaft 13 is a rotational shaft for driving the fuel pump 21 (see FIG. 1 to FIG. 3, and FIG. 5). The fuel pump 21 is a high-pressure fuel pump which pressurizes fuel to a high pressure state by a reciprocating plunger 22 (see FIG. 9 and FIG. 10) for supplying high-pressurized fuel to an injector (not illustrated). The plunger 22 is driven by rotating the fuel pump drive shaft 13 for pumping fuel. Further, bearing portions 35, 37, 54, and 56 (see FIG. 9 and FIG. 10), which will be described later, for supporting the fuel pump drive shaft 13 are integrally formed on a flange portion 29 to be described later.

Figure 4:
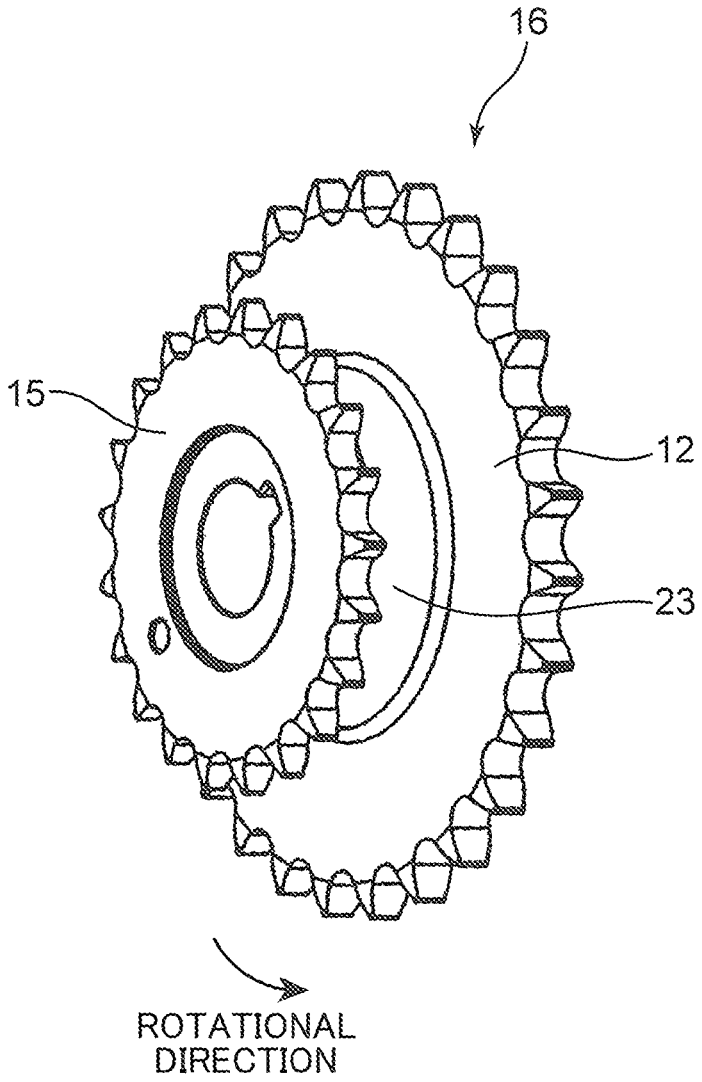
FIG. 4 is a perspective view illustrating a dual sprocket in the embodiment of the present invention.

As illustrated in FIG. 4, the dual sprocket 16 includes a first sprocket 12 and a second sprocket 15 facing each other.

More specifically, as illustrated in FIG. 4, the dual sprocket 16 is provided with the annular first sprocket 12, the annular second sprocket 15 whose outer diameter is smaller than the outer diameter of the first sprocket 12, and a tubular connecting portion 23 for integrally connecting the first sprocket 12 and the second sprocket 15. The connecting portion 23 includes a shaft insertion hole (not illustrated) axially passing through the connection portion 23. The dual sprocket 16 is fixed to the fuel pump drive shaft 13 in a state that the fuel pump drive shaft 13 passes through the shaft insertion hole.

As illustrated in FIG. 3, the first timing chain 11 is wound between the first sprocket 12 and the crank sprocket 10, and the second timing chain 2 is wound between the second sprocket 15, the exhaust cam sprocket 3, and the intake cam sprocket 4.

The driving force transmission system 30 having the aforementioned configuration is covered by a timing chain cover (not illustrated), which is formed on a surface of the engine body 63 in the direction orthogonal to the crankshaft direction (namely, on a surface of the engine body 63 on the engine rear side).

As illustrated in FIG. 1 and FIG. 2, the transmission 28 is disposed on the rear side of the cylinder block 25. The transmission 28 is connected to the crankshaft 9 (see FIG. 2), and a driving force of the crankshaft 9 is transmitted to rear wheels 75 via a propeller shaft 74 (see FIG. 1). Note that the reference numeral 77 in FIG. 1 denotes front wheels.

Next, the engine body 63 and the fuel pump 21 are described in details.

As illustrated in FIG. 3, the engine body 63 includes the cylinder head 24, the cylinder block 25, a crank case 26, and an oil pan (not illustrated).

Figure 6:
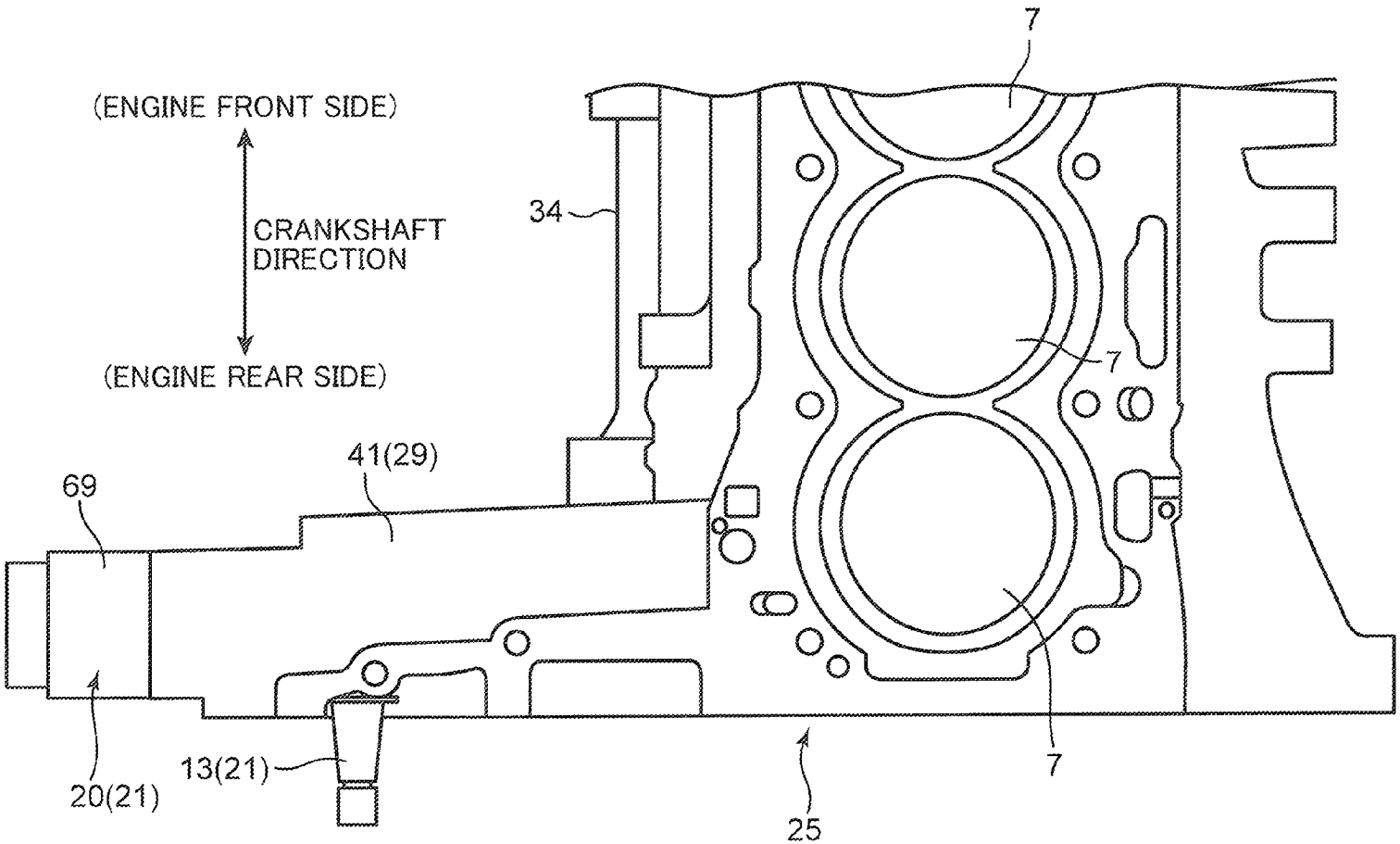
FIG. 6 is a plan view illustrating a part of a cylinder block in the embodiment of the present invention, specifically, a state that a cylinder head is removed.
Figure 7:
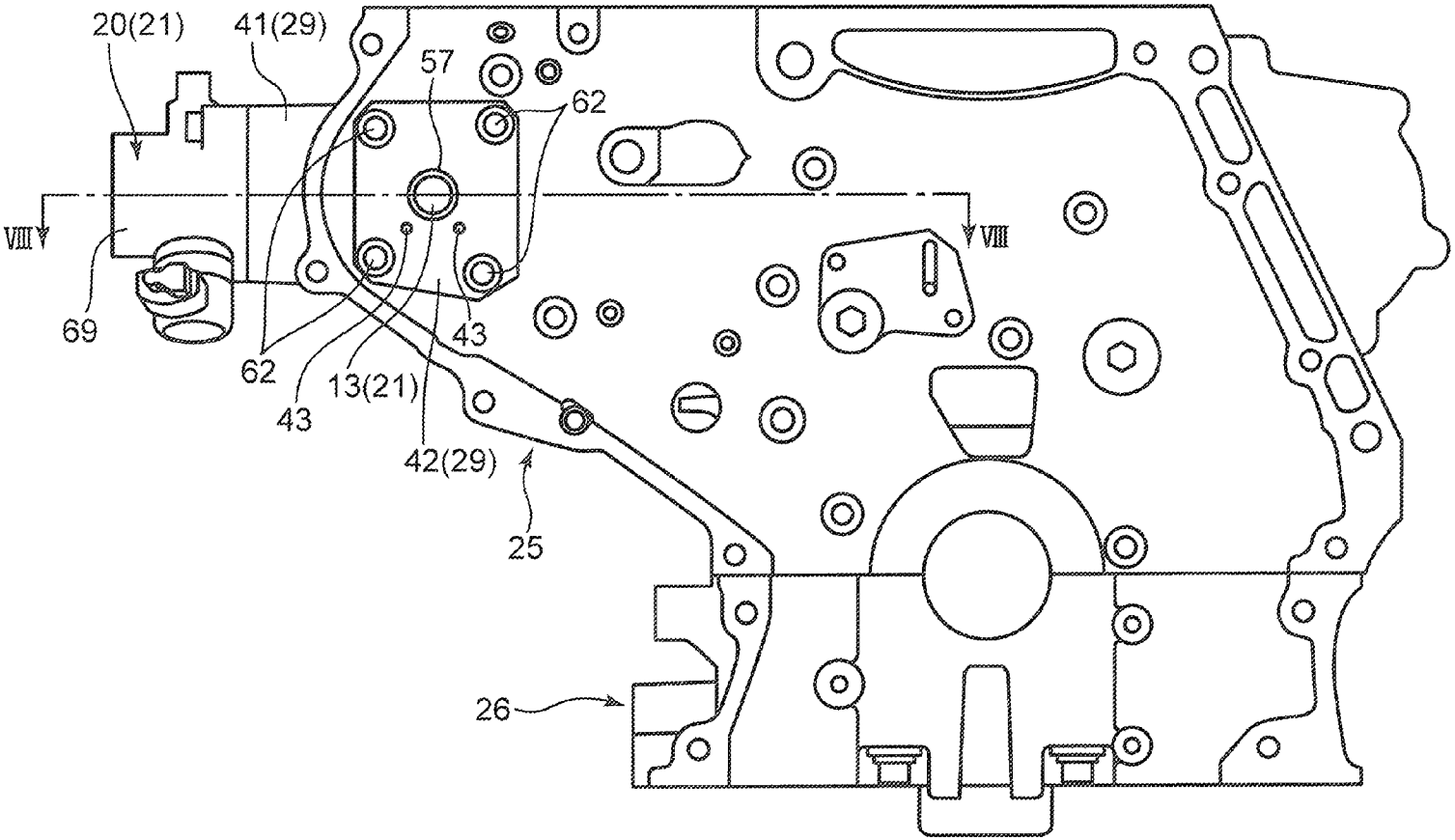
FIG. 7 is a side view of the cylinder block in the embodiment of the present invention when viewed from the engine rear side, specifically, a state that each of the sprockets is removed.

The cylinder block 25 includes four cylinder bores 7 (see FIG. 6). In FIG. 6, only three cylinder bores 7 are illustrated. A piston (not illustrated) is slidably accommodated in each of the cylinder bores 7. A combustion chamber (not illustrated) is formed for each of the cylinders by the pistons, the cylinder bores 7, the cylinder head 24, and intake and exhaust valves (not illustrated).

Figure 5:
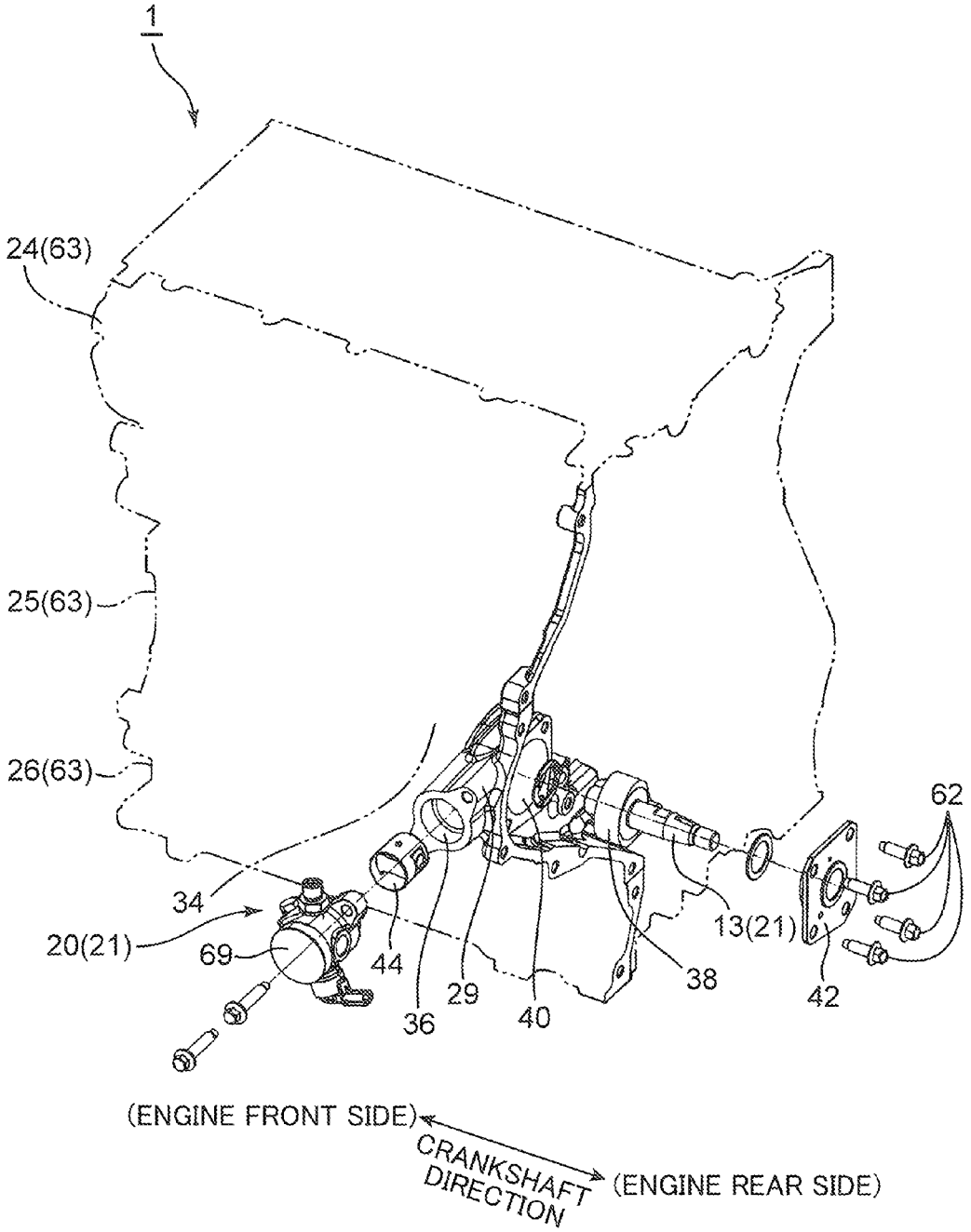
FIG. 5 is a perspective view of a configuration of the engine in the embodiment of the present invention in a state that a fuel pump is removed.

Further, as illustrated in FIG. 5 to FIG. 10, the cylinder block 25 is provided with the flange portion 29, on an end portion of the cylinder block 25 on the engine rear side, projecting from a side surface 34 of the end portion along the crankshaft direction (namely, from a left surface of the cylinder block 25 in the vehicle width direction in the example illustrated in FIG. 5 and FIG. 6) in the direction orthogonal to the crankshaft direction (toward the left side in the vehicle width direction in the example illustrated in FIG. 5 and FIG. 6).

The projecting length of the flange portion 29 is set to a length at which the fuel pump 21 does not interfere with the transmission 28. More specifically, an offset amount X (see FIG. 1 and FIG. 2), which is a distance between the crankshaft 9 and the fuel pump drive shaft 13 in the direction orthogonal to the crankshaft direction, is set to a length at which the fuel pump drive shaft 13 does not interfere with the transmission 28. The symbol A in FIG. 1 and FIG. 2 denotes the position of the crankshaft 9 in the direction orthogonal to the crankshaft direction (namely, the center of axis of the crankshaft 9). The symbol B in FIG. 1 and FIG. 2 denotes the position of the fuel pump drive shaft 13 in the direction orthogonal to the crankshaft direction (namely, the center of axis of the fuel pump drive shaft 13).

Figure 8:
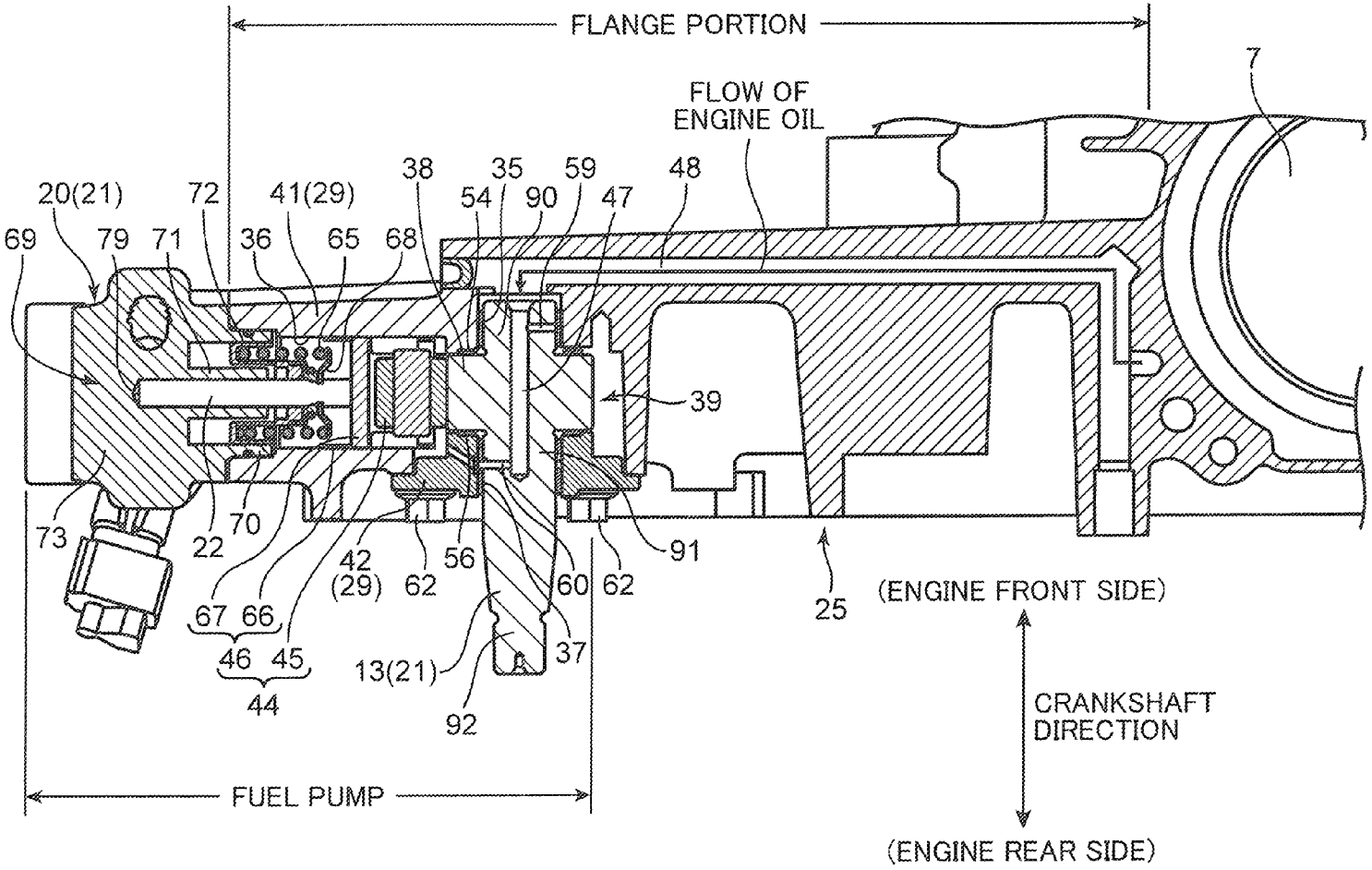
FIG. 8 is a sectional view taken along the line VIII-VIII in FIG. 7.
Figure 9:
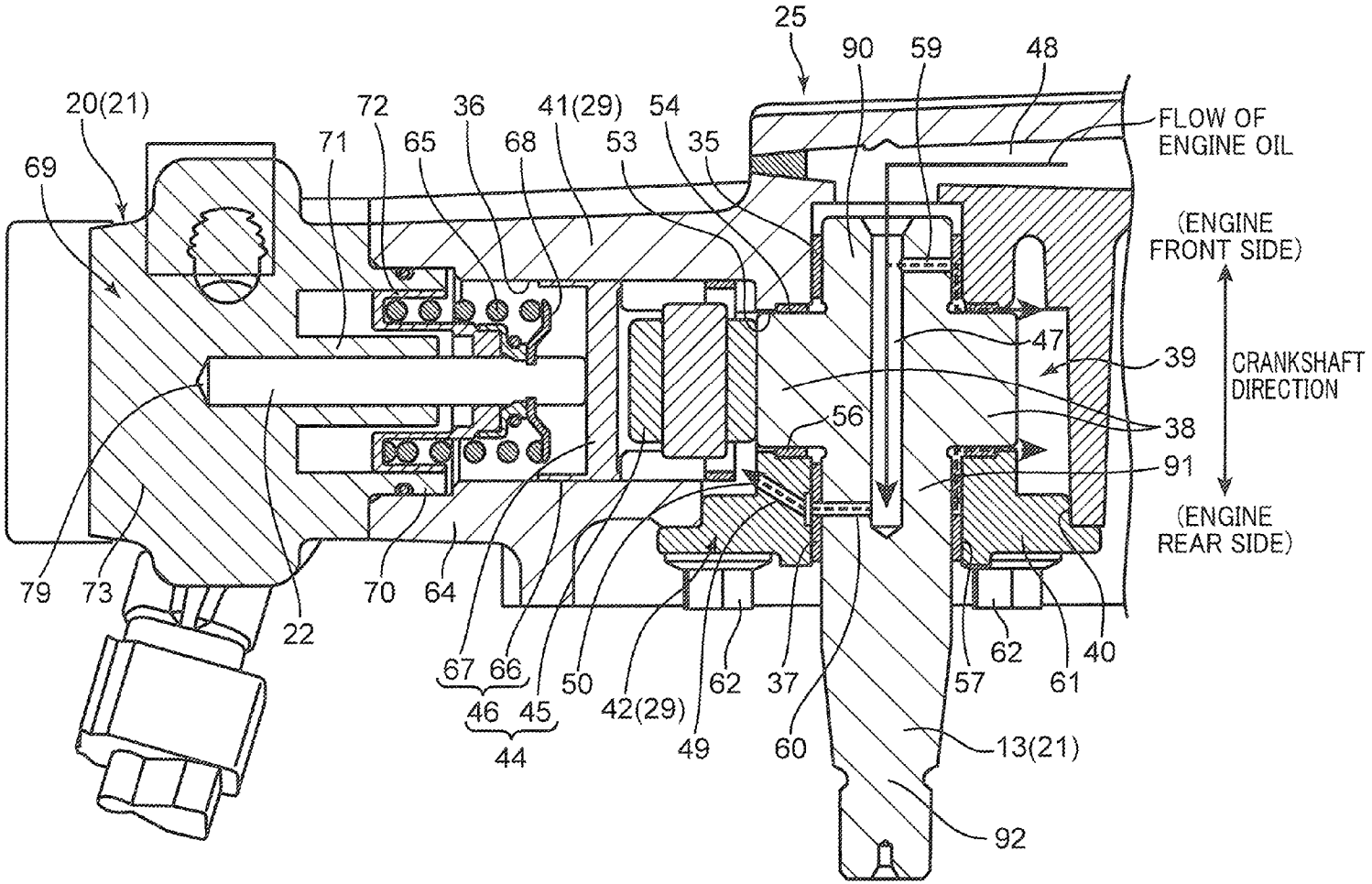
FIG. 9 is a sectional view enlargedly illustrating essential parts in FIG. 8.

As illustrated in FIG. 8 and FIG. 9, the fuel pump 21 is provided with the fuel pump drive shaft 13 and the fuel pump body 20.

The fuel pump drive shaft 13 is disposed along the crankshaft direction, and is rotatably supported on the bearing portions 35, 37, 54, and 56 of the flange portion 29 to be described later. The fuel pump drive shaft 13 includes, in the order from the engine front side, a front-side support shaft portion 90, a cam portion 38 (corresponding to a cam of the present invention), a rear-side support shaft portion 91, and a sprocket mounting portion 92. The cam portion 38 is formed to project radially outwardly from the front-side support shaft portion 90 and from the rear-side support shaft portion 91 at an intermediate portion of the fuel pump drive shaft 13. A center portion of the dual sprocket 16 is fixed to the sprocket mounting portion 92. Further, the fuel pump drive shaft 13 includes a drive-shaft-side oil supply path 47 (see FIG. 8 and FIG. 9) for supplying engine oil to the bearing portions 35, 37, 54, and 56.

As illustrated in FIG. 8 and FIG. 9, the drive-shaft-side oil supply path 47 is formed to extend in the axis direction of the fuel pump drive shaft 13 within the fuel pump drive shaft 13, and is formed in a region from an end of the drive-shaft-side oil supply path 47 on the engine front side in the axis direction of the fuel pump drive shaft 13 to a middle portion thereof in the axis direction of the fuel pump drive shaft 13. Further, the fuel pump drive shaft 13 includes a first radial direction passage 59 and a second radial direction passage 60, each of which extends from a halfway portion of the drive-shaft-side oil supply path 47 in the axis direction of the fuel pump drive shaft 13 toward radially outwardly.

The first radial direction passage 59 is formed in the front-side support shaft portion 90. A radially outer end of the first radial direction passage 59 is opened in the outer surface of the fuel pump drive shaft 13. The opening portion of the first radial direction passage 59 faces the bearing portion 35.

The second radial direction passage 60 is formed in the rear-side support shaft portion 91. A radially outer end of the second radial direction passage 60 is opened in the outer surface of the fuel pump drive shaft 13. The opening portion of the second radial direction passage 60 faces a groove portion 58 in the bearing portion 37 to be described later.

Figure 10:
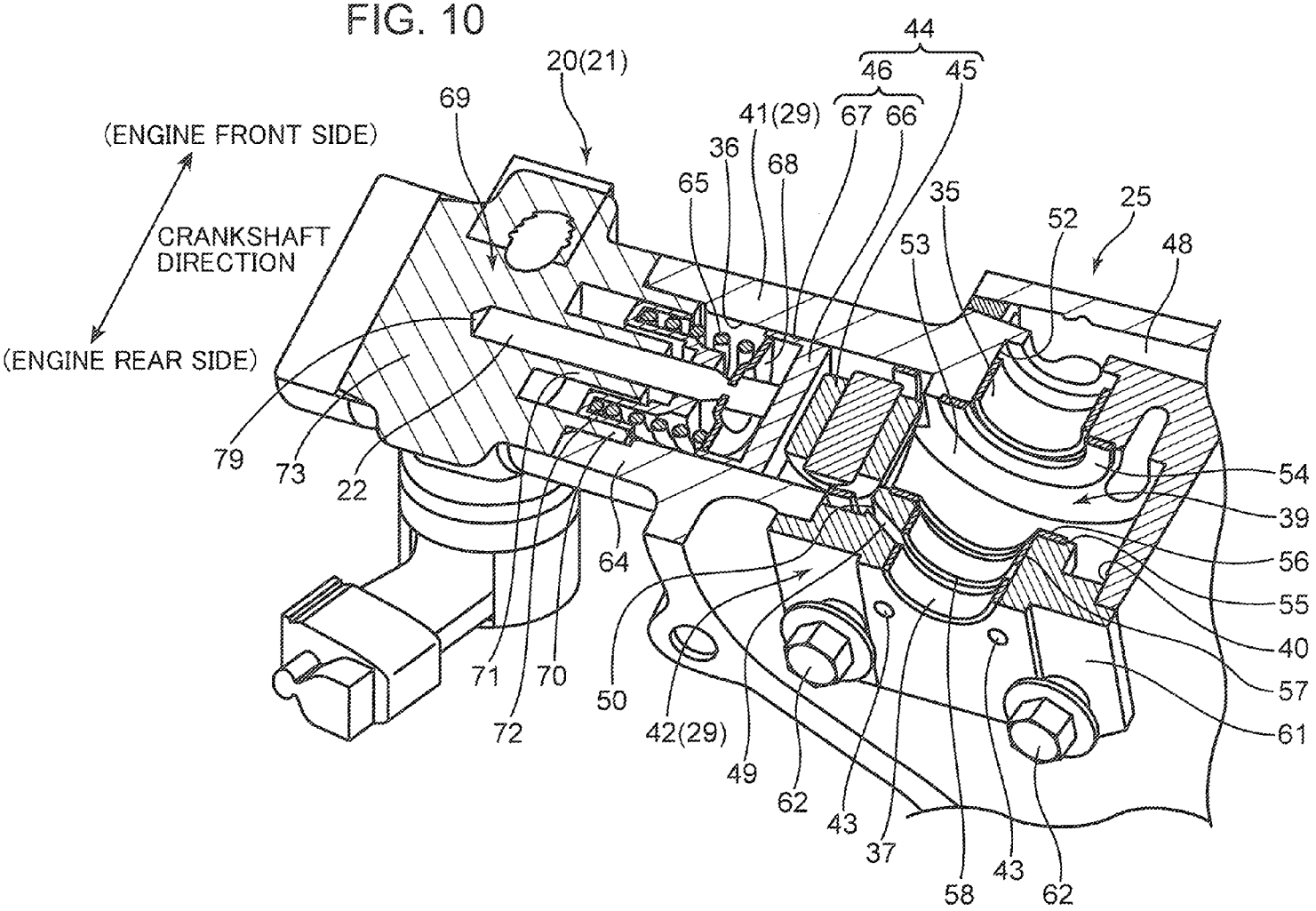
FIG. 10 is a perspective view of the essential parts illustrated in FIG. 9 when viewed in an oblique direction.

As illustrated in FIG. 8 to FIG. 10, the fuel pump body 20 is provided with the plunger 22 which reciprocates in a pump accommodating hole portion 36 in the direction orthogonal to the crankshaft direction, a base portion 69 including a pressure chamber 79 for pumping fuel by causing the plunger 22 to move in the direction orthogonal to the crankshaft direction, and a roller lifter 44 and a coil spring 65 disposed between the plunger 22 and the cam portion 38.

As illustrated in FIG. 8 to FIG. 10, the base portion 69 is formed into a generally tubular shape as a whole. The base portion 69 includes a fuel pumping portion 73 including the pressure chamber 79 formed therein, a plunger support portion 71 for slidably movably supporting the plunger 22 in the direction orthogonal to the crankshaft direction, a spring support portion 72 for supporting an end of the coil spring 65 on the side opposite to the cylinder bores 7, and a tubular held portion 70 which is held in a flange portion body 41 in a state that the held portion 70 is placed in the pump accommodating hole portion 36 of the flange portion body 41. The plunger support portion 71, the spring support portion 72, and the held portion 70 are integrally formed of the same material as the fuel pumping portion 73 on the side of the cylinder bores 7 in the fuel pumping portion 73, and are placed in the pump accommodating hole portion 36.

As illustrated in FIG. 9, FIG. 10, and FIG. 12 to FIG. 14, the roller lifter 44 includes a tubular roller 45 which is disposed in contact with a cam surface of the cam portion 38 (see FIG. 9 and FIG. 10), and is rotated as the cam portion 38 is rotated; and a plunger pressing portion 46 which is slidably moved in the axis direction of the plunger 22 within the pump accommodating hole portion 36 as the cam portion 38 is rotated, while rotatably supporting the roller 45 for reciprocating the plunger 22.

Figure 14:
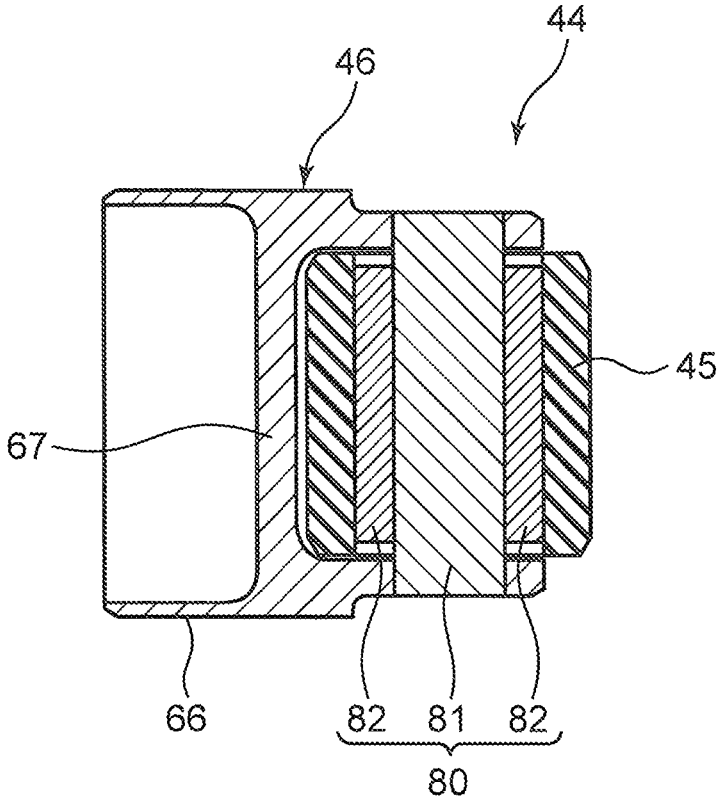
FIG. 14 is a sectional view of the roller lifter taken along the line XIV-XIV in FIG. 13.

The plunger pressing portion 46 includes a tubular casing portion 66 (see FIG. 12 to FIG. 14), a pressing wall 67 (see FIG. 14) which is integrally formed with the casing portion 66 within the casing portion 66, and a roller bearing 80 (see FIG. 14) which is disposed in the casing portion 66 and is configured to rotatably support the roller 45. As illustrated in FIG. 14, the roller bearing 80 includes a shaft 81, and a plurality of rollers 82 disposed around the shaft 81. The outer surface of the casing portion 66 is slidably in contact with the inner surface of the pump accommodating hole portion 36 in the direction orthogonal to the crankshaft direction. As illustrated in FIG. 8 to FIG. 10, the pressing wall 67 is in contact with an end surface of the plunger 22 on the side of the cylinder bores 7. When the pressing wall 67 is moved toward the side opposite to the cylinder bores 7 as the cam portion 38 is rotated, the plunger 22 is moved toward the side opposite to the cylinder bores 7 for pumping fuel in the pressure chamber 79.

As illustrated in FIG. 8 to FIG. 10, the coil spring 65 is a compression coil disposed in such a manner that the axis direction thereof is aligned with the direction orthogonal to the crankshaft direction. An end of the plunger 22 on the side of the cylinder bores 7 is fixed to an end of the coil spring 65 on the side of the cylinder bores 7 via a disc-shaped connection plate 68. The coil spring 65 urges the plunger pressing portion 46 toward the cylinder bores 7. The coil spring 65 is expanded and contracted as the cam portion 38 is rotated. When the coil spring 65 is expanded, the coil spring 65 moves the plunger 22 toward the cylinder bores 7. Causing the plunger 22 to move toward the cylinder bores 7 makes it possible to slidably move the roller lifter 44 toward the cylinder bores 7.

In the following, the flange portion 29 is described in details.

As illustrated in FIG. 8 to FIG. 10, the flange portion 29 includes the flange portion body 41 and a cover member 42.

The flange portion body 41 includes a flange-side oil supply path 48, a cam accommodating hole portion 39, and the bearing portions 35 and 54 on the side of the cylinder bores 7 (on the right side in FIG. 8 to FIG. 10). The flange portion body 41 further includes the pump accommodating hole portion 36 on the side opposite to the cylinder bores 7 (on the left side in FIG. 8 to FIG. 10). The pump accommodating hole portion 36 is formed into a tubular shape in such a manner that the axis direction thereof is aligned with the direction orthogonal to the crankshaft direction, and accommodates the fuel pump body 20 therein.

As illustrated in FIG. 8 to FIG. 10, the flange-side oil supply path 48 extends in the direction orthogonal to the crankshaft direction within the flange portion body 41. An upstream end of the flange-side oil supply path 48 communicates with a main oil gallery (not illustrated) within the cylinder block 25. A downstream end of the flange-side oil supply path 48 communicates with an upstream end of the drive-shaft-side oil supply path 47 in the fuel pump drive shaft 13. The flange-side oil supply path 48 supplies engine oil that is pumped up from an oil pan by an oil pump (not illustrated) and flows through the main oil gallery to the drive-shaft-side oil supply path 47.

The cam accommodating hole portion 39 is formed into a tubular shape in such a manner that the axis direction thereof is aligned with the crankshaft direction. As illustrated in FIG. 9, the cam accommodating hole portion 39 accommodates the cam portion 38 in such a manner that the cam portion 38 can be rotated within the cam accommodating hole portion 39.

As illustrated in FIG. 10, the bearing portion 35 is formed on the inner surface of a shaft insertion hole 52 passing through an inner wall surface 53, which constitutes the cam accommodating hole portion 39 on one side in the crankshaft direction (namely, on the engine front side). In the example illustrated in FIG. 10, the bearing portion 35 is a tubular journal slide bearing which supports a radial load of the fuel pump drive shaft 13. The bearing portion 35 rotatably supports the front-side support shaft portion 90.

The bearing portion 54 is formed on the inner wall surface 53. In the example illustrated in FIG. 10, the bearing portion 54 is an annular thrust slide bearing which supports an axial load of the fuel pump drive shaft 13. The bearing portion 54 is slidably in contact with an end surface of the cam portion 38 on the engine front side.

Engine oil is supplied to the bearing portions 35 and 54 through the first radial direction passage 59. Thus, engine oil lubricates between the bearing portion 35 and the fuel pump drive shaft 13, and lubricates between the bearing portion 54 and the cam portion 38. After being used for lubrication, engine oil is allowed to flow into the cam accommodating hole portion 39.

As illustrated in FIG. 10, the flange portion body 41 includes an opening portion 40, which is opened toward an end of the cam accommodating hole portion 39 on the other side (on the engine rear side) in the crankshaft direction for receiving the fuel pump drive shaft 13 therethrough. The opening portion 40 is covered by the cover member 42.

As illustrated in FIG. 9 and FIG. 10, the cover member 42 is a plate-shaped member which is mounted on the flange portion body 41 to cover the opening portion 40. The cover member 42 includes a cover member body 61, and the bearing portions 37 and 56 to be mounted on the cover member body 61.

More specifically, the cover member body 61 is a rectangular plate-shaped member. Bolt insertion holes (not illustrated) are formed in four corners of the cover member body 61, respectively. As illustrated in FIG. 9 and FIG. 10, the cover member body 61 is fixed to the flange portion body 41 in such a manner as to cover the opening portion 40 of the flange portion body 41. Specifically, the cover member body 61 is fastened to the flange portion body 41 in a state that a bolt 62 is inserted in each of the bolt insertion holes.

As illustrated in FIG. 9 and FIG. 10, a shaft insertion hole 57 passing through the cover member body 61 in the crankshaft direction is formed in the middle portion of the cover member body 61. The bearing portion 37 is formed on the inner surface of the shaft insertion hole 57. In the example illustrated in FIG. 10, the bearing portion 37 is a tubular journal slide bearing which supports a radial load of the fuel pump drive shaft 13. The bearing portion 37 rotatably supports the rear-side support shaft portion 91.

The groove portion 58 is circumferentially formed over the entire circumference of an axially middle portion on the inner surface of the bearing portion 37. The groove portion 58 communicates with the second radial direction passage 60 in the fuel pump drive shaft 13. Engine oil is allowed to flow through the groove portion 58 via the second radial direction passage 60.

The bearing portion 56 is formed on an inner wall surface 55 of the cover member 42 (namely, on a surface facing the inner wall surface 53). In the example illustrated in FIG. 10, the bearing portion 56 is an annular thrust slide bearing which supports an axial load of the fuel pump drive shaft 13. The bearing portion 56 is slidably in contact with an end surface of the cam portion 38 on the engine rear side.

A part of engine oil flowing to the groove portion 58 is supplied to the entirety of the bearing portion 37 and to the bearing portion 56 to lubricate between the bearing portion 37 and the fuel pump drive shaft 13, and to lubricate between the bearing portion 56 and the cam portion 38. After being used for lubrication, engine oil is allowed to flow into the cam accommodating hole portion 39.

Further, the cover member body 61 includes a cover-side oil supply path 49 for guiding engine oil supplied to the groove portion 58 toward the roller lifter 44. An oil injection port 50 for injecting engine oil toward the roller lifter 44 is formed in a downstream end of the cover-side oil supply path 49. The diameter of the oil injection port 50 is set smaller than the diameter of an upstream portion of the oil injection port 50 in the cover-side oil supply path 49. According to this configuration, the flow rate of engine oil increases in the oil injection port 50. This makes it possible to inject engine oil from the oil injection port 50.

Figure 11:
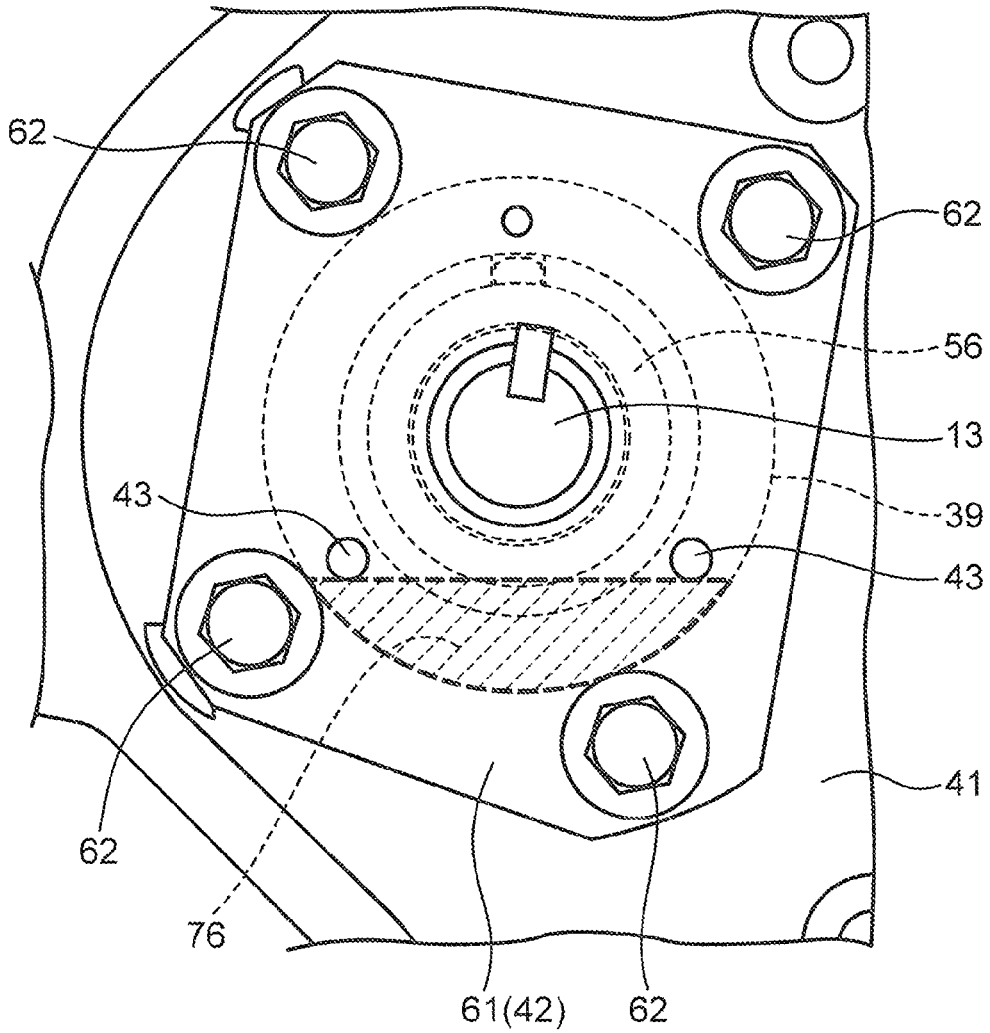
FIG. 11 is a diagram illustrating the vicinity of a cover member of a flange portion in the embodiment of the present invention.
Figure 12:
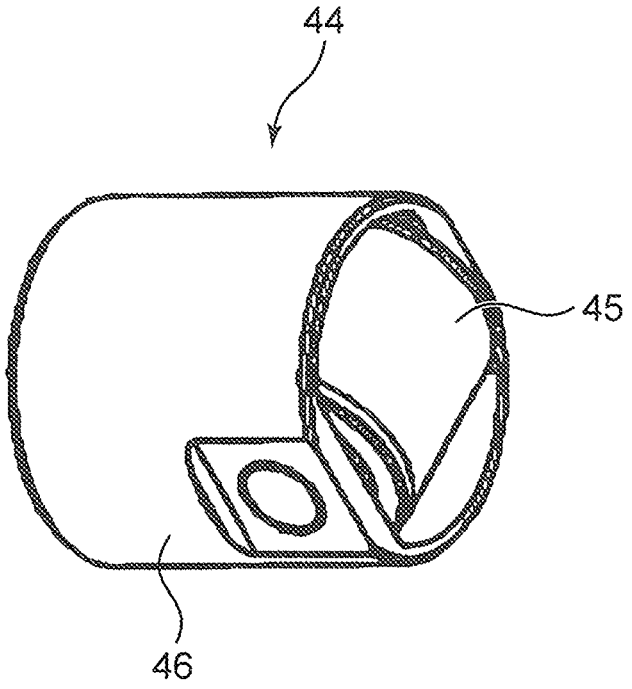
FIG. 12 is a perspective view illustrating a roller lifter in the embodiment of the present invention.
Figure 13:
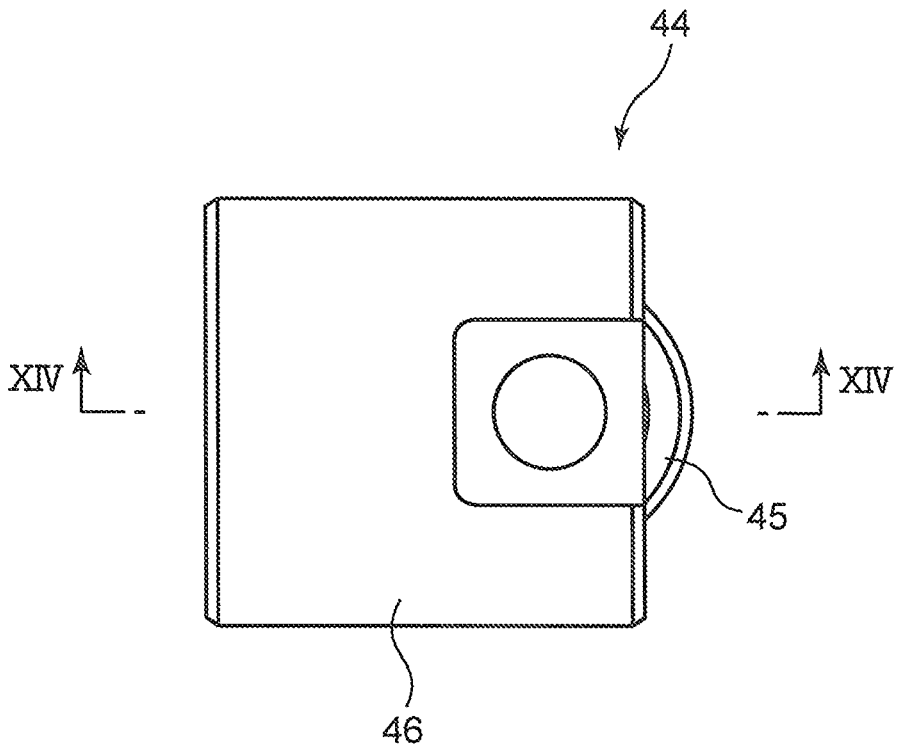
FIG. 13 is a side view illustrating the roller lifter in the embodiment of the present invention.

As illustrated in FIG. 10 and FIG. 11, the cover member body 61 further includes two oil exit ports 43. The oil exit ports 43 are opening portions for drawing out engine oil remaining in the cam accommodating hole portion 39. As illustrated in FIG. 11, each of the oil exit ports 43 is located slightly upper than the lower end of the bearing portion 56. According to this configuration, engine oil lubricates between the bearing portion 56 and the cam portion 38. Further, when the liquid surface level of engine oil within the cam accommodating hole portion 39 reaches a level slightly higher than the lower end of the bearing portion 56, engine oil is drawn out from the oil exit ports 43. An outer end of each of the oil exit ports 43 communicates with the oil pan. Therefore, engine oil drawn out from the oil exit ports 43 is allowed to fall onto the oil pan.

As illustrated in FIG. 9 and FIG. 10, the pump accommodating hole portion 36 is formed by the inner wall surface of a tubular peripheral wall portion 64, which is formed to extend in the direction orthogonal to the crankshaft direction on a tip end side of the flange portion body 41 (namely, on the side opposite to the cylinder bores 7). A tip end of the pump accommodating hole portion 36 is opened. The pump accommodating hole portion 36 accommodates and holds the plunger 22, the coil spring 65, and the roller lifter 44 as constituent elements of the fuel pump 21 therein. In other words, the peripheral wall portion 64 of the flange portion body 41 plays a role of a housing for housing the plunger 22, the coil spring 65, and the roller lifter 44.

As illustrated in FIG. 9 and FIG. 10, an end of the pump accommodating hole portion 36 on the side of the cylinder bores 7 communicates with an end of the cam accommodating hole portion 39 on the side opposite to the cylinder bores 7. According to this configuration, engine oil injected from the oil injection port 50 toward the roller lifter 44 is allowed to flow in the vicinity of the roller lifter 44 within the pump accommodating hole portion 36, and lubricates between the roller 45 and the cam portion 38. Thereafter, engine oil is allowed to flow into the cam accommodating hole portion 39. When the liquid surface level of engine oil flowing into the cam accommodating hole portion 39 reaches the height of the oil exit ports 43, engine oil is drawn out from the oil exit ports 43.

Advantageous Effects of the Embodiment

In the embodiment, as illustrated in FIG. 8 to FIG. 10, the fuel pump body 20 is accommodated in the pump accommodating hole portion 36 of the flange portion 29. This makes it possible to integrally assemble the fuel pump body 20 with the flange portion 29. Thus, the fuel pump 21 and the cylinder block 25 are formed into a unit. In other words, the flange portion 29 has a structure for supporting the fuel pump body 20 in a state that the fuel pump body 20 is accommodated in the flange portion 29. This makes it possible to increase the rigidity of the flange portion 29 (support rigidity) for supporting the fuel pump body 20, as compared with a flange portion of a structure in which a fuel pump is supported in a cantilever state. This is advantageous in suppressing deformation of the flange portion 29 at the time of collision against a vehicle and deformation of the flange portion 29 due to a tension force of the timing chain 11, in suppressing breakage or damage of the fuel pump body 20 or a fuel pipe (not illustrated), and in keeping the tension of the timing chains 11 and 2 in an appropriate state.

Further, the fuel pump 21 is mounted on the flange portion 29, which projects from an end of the cylinder block 25 on the engine rear side in the direction orthogonal to the crankshaft direction. This makes it possible to avoid interference between the transmission 28 and the fuel pump 21.

Further, the fuel pump drive shaft 13 is directly supported on the flange portion 29. This is advantageous in increasing the positional precision of the fuel pump drive shaft 13 with respect to the cylinder block 25, as compared with a configuration, in which a fuel pump drive shaft is supported on a pump housing formed on a surface of a flange portion. This makes it possible to keep the tension of the timing chains 11 and 2 in an appropriate state, and to suppress a driving resistance of the engine 1 from increasing. This is advantageous in suppressing deterioration of fuel efficiency.

Further, in the embodiment, when the fuel pump drive shaft 13 is mounted on the flange portion 29, the fuel pump drive shaft 13 is inserted in the cam accommodating hole portion 39 through the opening portion 40 of the flange portion 29 illustrated in FIG. 5, FIG. 9, and FIG. 10 (see FIG. 5). Then, after the cam portion 38 is placed in the cam accommodating hole portion 39, the opening portion 40 is covered by the cover member 42. This makes it easy to mount the fuel pump drive shaft 13 to the flange portion 29. Further, providing the cover member 42 makes it possible to prevent the fuel pump drive shaft 13 from falling off from the opening portion 40.

Further, in the embodiment, the bearing portions 37 and 56 formed on the cover member 42 makes it possible to securely support the fuel pump drive shaft 13.

Further, in the embodiment, when engine oil 76 reaches the height of the oil exit ports 43 within the cam accommodating hole portion 39 illustrated in FIG. 11, the engine oil 76 is drawn out from the oil exit ports 43. Therefore, appropriately setting the height of the oil exit ports 43 makes it possible to keep the liquid surface level of the engine oil 76 in the cam accommodating hole portion 39 to an appropriate level. Thus, it is possible to appropriately lubricate and cool the cam portion 38. Further, as illustrated in FIG. 8 to FIG. 10, the flange-side oil supply path 48 is formed in the flange portion body 41. This makes it possible to lubricate and cool the cam portion 38 without providing an oil supply pipe on the outside of the flange portion 29. This is advantageous in reducing the number of parts.

Further, in the embodiment, the roller lifter 44 illustrated in FIG. 8 to FIG. 10, and FIG. 12 to FIG. 14 transforms rotational motion of the cam portion 38 to rectilinear motion, and transfers the motion to the plunger 22. This makes it possible to appropriately reciprocate the plunger 22 to thereby appropriately operate the fuel pump body 20. Furthermore, since the roller 45 is in contact with the cam surface of the cam portion 38, it is possible to suppress wear of the cam surface due to friction, and to suppress heat caused by friction.

Further, in the embodiment, as illustrated in FIG. 9, engine oil is supplied to the bearing portions 35, 37, 54, and 56 via the flange-side oil supply path 48 and the drive-shaft-side oil supply path 47. This makes it possible to lubricate and cool the bearing portions 35, 37, 54, and 56 without providing an oil supply pipe on the outside of the flange portion 29.

Further, in the embodiment, as illustrated in FIG. 9, engine oil is supplied to the roller lifter 44 via the cover-side oil supply path 49. This makes it possible to lubricate and cool the roller lifter 44.

Further, in the embodiment, as illustrated in FIG. 9, engine oil is injected toward the roller lifter 44 from the oil injection port 50. This is advantageous in lubricating and cooling the roller lifter 44.

Figure 15:
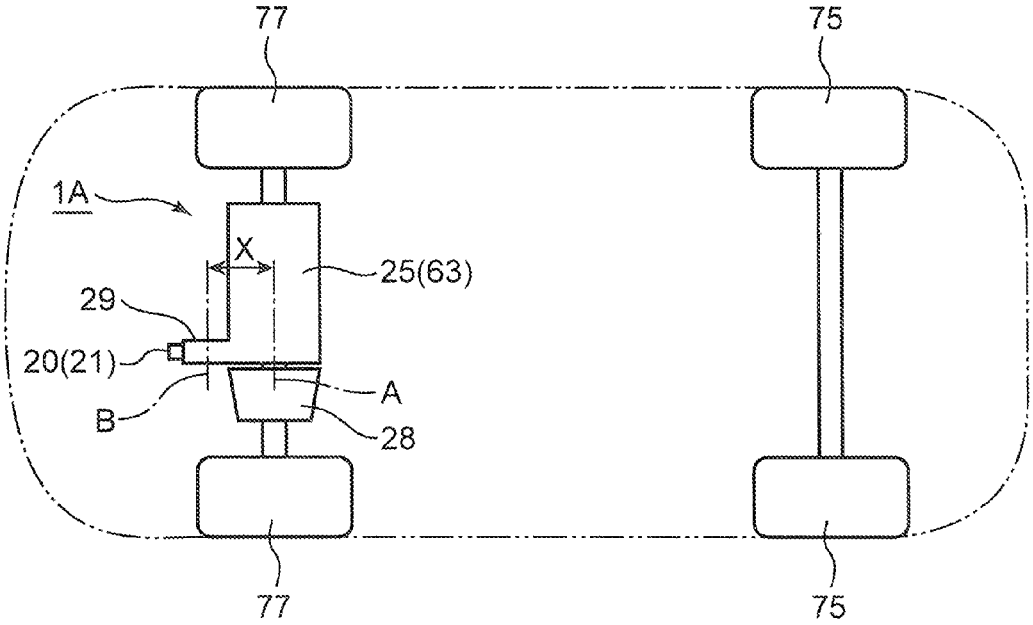
FIG. 15 is a plan view schematically illustrating a configuration of a vehicle as a modification of the embodiment of the present invention.

The fuel pump mounting structure of the embodiment is applied to an FR car. However, as illustrated in FIG. 15, the fuel pump mounting structure of the embodiment may be applied to an FF (front-engine front-drive) car in which front wheels 77 are driven. In this case, an engine 1A is placed in a transverse posture, in which the cylinder array direction is aligned with the vehicle width direction. A flange portion 29 is formed to project from a surface of an engine body 63 on the vehicle front side toward the vehicle front side. A fuel pump 21 is accommodated and held in a pump accommodating hole portion (not illustrated) of the flange portion 29. Also, in this configuration, the same advantageous effects as the embodiment are obtained.

SUMMARY OF EMBODIMENT

The following is a summary of the features and the advantageous effects of a fuel pump mounting structure for an engine, which is disclosed in the embodiment.

The fuel pump mounting structure for an engine, which is disclosed in the embodiment, is a structure for mounting, on a cylinder block, a fuel pump including a fuel pump drive shaft which is rotated by receiving a driving force of a crankshaft, and a fuel pump body which is operated as the fuel pump drive shaft is rotated for pumping fuel. The cylinder block includes a flange portion, on an end portion of the cylinder block in a crankshaft direction, projecting from a surface of the end portion along the crankshaft direction in a direction orthogonal to the crankshaft direction. The flange portion includes a bearing portion which rotatably supports the fuel pump drive shaft, and a pump accommodating hole portion which accommodates the fuel pump body. The fuel pump drive shaft is rotatably supported on the bearing portion. The fuel pump body is accommodated in the pump accommodating hole portion.

In the fuel pump mounting structure for an engine, the fuel pump body is accommodated in the pump accommodating hole portion of the flange portion. This makes it possible to integrally assemble the fuel pump body with the flange portion. Thus, the fuel pump and the cylinder block are formed into a unit. In other words, the flange portion has a structure for supporting the fuel pump body in a state that the fuel pump body is accommodated in the flange portion. This makes it possible to increase the rigidity of the flange portion (support rigidity of the fuel pump) for supporting the fuel pump body, as compared with a flange portion of a structure in which a fuel pump is supported in a cantilever state. This is advantageous in suppressing deformation of the flange portion at the time of collision against a vehicle and deformation of the flange portion due to a tension force of a timing chain, in suppressing breakage or damage of the fuel pump body or a fuel pipe, and in keeping the tension of the timing chain in an appropriate state.

Further, the fuel pump is mounted on the flange portion, which projects from an end portion of the cylinder block in the direction orthogonal to the crankshaft direction. This makes it possible to avoid interference between a transmission and the fuel pump when the fuel pump is mounted on a portion of the cylinder block on the transmission side.

Further, the fuel pump drive shaft is directly supported on the flange portion. This is advantageous in increasing the positional precision of the fuel pump drive shaft with respect to the cylinder block, as compared with a configuration, in which a fuel pump drive shaft is supported on a pump housing formed on one surface of a flange portion. This makes it possible to keep the tension of a timing chain in an appropriate state, and to suppress a driving resistance of the engine from increasing. This is advantageous in suppressing deterioration of fuel efficiency.

In the fuel pump mounting structure for an engine, preferably, a cam for driving the fuel pump body may be formed on an axially intermediate portion of the fuel pump drive shaft. The flange portion may include a flange portion body, and a cover member mounted on the flange portion body and configured to cover the opening portion. The flange portion body has the pump accommodating hole portion, a cam accommodating hole portion communicating with the pump accommodating hole portion and configured to accommodate the cam, and an opening portion communicating with the cam accommodating hole portion and configured to receive the fuel pump drive shaft therethrough.

According to the aforementioned configuration, when the fuel pump drive shaft is mounted on the flange portion, the fuel pump drive shaft is inserted in the cam accommodating hole portion through the opening portion. Then, after the cam is disposed in the cam accommodating hole portion, the opening portion is covered by the cover member. This makes it easy to mount the fuel pump drive shaft to the flange portion. Further, providing the cover member makes it possible to prevent the fuel pump drive shaft from falling off from the opening portion.

In the fuel pump mounting structure for an engine, preferably, the bearing portion may be formed on the cover member.

According to the aforementioned configuration, the bearing portion formed on the cover member makes it possible to securely support the fuel pump drive shaft.

In the fuel pump mounting structure for an engine, preferably, the flange portion body may include a flange-side oil supply path for supplying engine oil to the cam accommodating hole portion. The cover member may include an oil exit port for drawing out engine oil remaining in the cam accommodating hole portion.

According to the aforementioned configuration, when engine oil reaches the height of an oil exit port within the cam accommodating hole portion, the engine oil is drawn out from the oil exit port. Therefore, appropriately setting the height of the oil exit port makes it possible to keep the liquid surface level of engine oil in the cam accommodating hole portion to an appropriate level. Thus, it is possible to appropriately lubricate and cool the cam. Further, the flange-side oil supply path is formed in the flange portion body. This makes it possible to lubricate and cool the cam without providing an oil supply pipe on the outside of the flange portion. This is advantageous in reducing the number of parts.

In the fuel pump mounting structure for an engine, preferably, the fuel pump body may include a plunger which reciprocates within the pump accommodating hole portion, and a roller lifter disposed between the plunger and the cam. The roller lifter may include a roller which is disposed in contact with a cam surface of the cam, and is configured to rotate as the cam is rotated, and a plunger pressing portion which is slidably moved within the pump accommodating hole portion in an axis direction of the plunger as the cam is rotated, while rotatably supporting the roller for reciprocating the plunger.

According to the aforementioned configuration, the roller lifter transforms rotational motion of the cam to rectilinear motion, and transfers the motion to the plunger. This makes it possible to appropriately reciprocate the plunger to thereby appropriately operate the fuel pump body. Furthermore, since the roller is in contact with the cam surface, it is possible to suppress wear of the cam surface due to friction, and to suppress heat caused by friction.

In the fuel pump mounting structure for an engine, preferably, the fuel pump drive shaft may include a drive-shaft-side oil supply path for supplying engine oil to the bearing portion. The flange portion body may include a flange-side oil supply path for supplying engine oil to the drive-shaft-side oil supply path.

According to the aforementioned configuration, engine oil is supplied to the bearing portion via the flange-side oil supply path and the drive-shaft-side oil supply path. This makes it possible to lubricate and cool the bearing portion without providing an oil supply pipe on the outside of the flange portion.

In the fuel pump mounting structure for an engine, preferably, the cover member may include a cover-side oil supply path for guiding engine oil supplied to the bearing portion toward the roller lifter.

According to the aforementioned configuration, engine oil is supplied to the roller lifter via the cover-side oil supply path. This makes it possible to lubricate and cool the roller lifter.

In the fuel pump mounting structure for an engine, preferably, the cover-side oil supply path may include an oil injection port for injecting engine oil toward the roller lifter.

According to the aforementioned configuration, engine oil is injected toward the roller lifter. This is advantageous in lubricating and cooling the roller lifter.

This application is based on Japanese Patent Application No. 2015-179759 filed on Sep. 11, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fuel pump mounting structure for an engine, for mounting, on a cylinder block, a fuel pump including a fuel pump drive shaft which is rotated by receiving a driving force of a crankshaft, and a fuel pump body which is operated as the fuel pump drive shaft is rotated for pumping fuel, wherein the cylinder block includes a flange portion, on an end portion of the cylinder block in a crankshaft direction, projecting from a surface of the end portion along the crankshaft direction in a direction orthogonal to the crankshaft direction, the flange portion including a bearing portion which rotatably supports the fuel pump drive shaft, and a pump accommodating hole portion which accommodates the fuel pump body, the fuel pump drive shaft is rotatably supported on the bearing portion, and the fuel pump body is accommodated in the pump accommodating hole portion.

2. The fuel pump mounting structure for an engine according to claim 1, wherein a cam for driving the fuel pump body is formed on an axially intermediate portion of the fuel pump drive shaft, and the flange portion includes a flange portion body, and a cover member mounted on the flange portion body and configured to cover the opening portion, the flange portion body having the pump accommodating hole portion, a cam accommodating hole portion communicating with the pump accommodating hole portion and configured to accommodate the cam, and an opening portion communicating with the cam accommodating hole portion and configured to receive the fuel pump drive shaft therethrough.

3. The fuel pump mounting structure for an engine according to claim 2, wherein the bearing portion is formed on the cover member.

4. The fuel pump mounting structure for an engine according to claim 2, wherein the flange portion body includes a flange-side oil supply path for supplying engine oil to the cam accommodating hole portion, and the cover member includes an oil exit port for drawing out engine oil remaining in the cam accommodating hole portion.

5. The fuel pump mounting structure for an engine according to claim 1, wherein the fuel pump body includes a plunger which reciprocates within the pump accommodating hole portion, and a roller lifter disposed between the plunger and the cam, and the roller lifter includes a roller which is disposed in contact with a cam surface of the cam, and is configured to rotate as the cam is rotated, and a plunger pressing portion which is slidably moved within the pump accommodating hole portion in an axis direction of the plunger as the cam is rotated, while rotatably supporting the roller for reciprocating the plunger.

6. The fuel pump mounting structure for an engine according to claim 3, wherein the fuel pump drive shaft includes a drive-shaft-side oil supply path for supplying engine oil to the bearing portion, and the flange portion body includes a flange-side oil supply path for supplying engine oil to the drive-shaft-side oil supply path.

7. The fuel pump mounting structure for an engine according to claim 6, wherein the cover member includes a cover-side oil supply path for guiding engine oil supplied to the bearing portion toward the roller lifter.

8. The fuel pump mounting structure for an engine according to claim 7, wherein the cover-side oil supply path includes an oil injection port for injecting engine oil toward the roller lifter.

* * * * *